US011891673B2

(12) United States Patent
Mousavi Rizi

(10) Patent No.: US 11,891,673 B2
(45) Date of Patent: Feb. 6, 2024

(54) METHOD OF PRESS-HARDENING A HOT-SHAPABLE PLATE

(71) Applicant: Seyed Amin Mousavi Rizi, Cologne (DE)

(72) Inventor: Seyed Amin Mousavi Rizi, Cologne (DE)

(73) Assignee: BILSTEIN GMBH & CO. KG, Hagen (DE)

( * ) Notice: Subject to any disclaimer, the term of this patent is extended or adjusted under 35 U.S.C. 154(b) by 324 days.

(21) Appl. No.: 17/343,142

(22) Filed: Jun. 9, 2021

(65) Prior Publication Data

US 2021/0395848 A1 Dec. 23, 2021

(30) Foreign Application Priority Data

Jun. 18, 2020 (DE) ..... 102020116126.3

(51) Int. Cl.

| | |
|---|---|
| ***C21D 7/13*** | (2006.01) |
| ***C21D 1/673*** | (2006.01) |
| ***C21D 1/34*** | (2006.01) |
| ***C21D 11/00*** | (2006.01) |
| ***C21D 8/02*** | (2006.01) |

(52) U.S. Cl.

CPC ..... *C21D 7/13* (2013.01); *C21D 1/34* (2013.01); *C21D 1/673* (2013.01); *C21D 8/0221* (2013.01); *C21D 8/0247* (2013.01); *C21D 11/005* (2013.01); *C21D 2241/00* (2013.01)

(58) Field of Classification Search

CPC ..... B21D 22/022; B21D 22/208; C21D 1/34; C21D 1/613; C21D 1/673; C21D 11/005; C21D 2241/00; C21D 7/13; C21D 8/0221; C21D 8/0247; C22C 38/00; C22C 38/02; C22C 38/04; C22C 38/28; C22C 38/32

See application file for complete search history.

(56) References Cited

FOREIGN PATENT DOCUMENTS

WO WO-2020165116 A1 * 8/2020 ..... C21D 1/18

* cited by examiner

*Primary Examiner* — Anthony M Liang
(74) *Attorney, Agent, or Firm* — Andrew Wilford

(57) ABSTRACT

A hot-shapable uncoated steel-plate workpiece is press hardened by first transporting the plate through a heating zone continuously or discontinuously and there heating the plate to an austenitizing temperature while blocking entry of oxygen into the heating zone. Then the heated plate is cooled in a cooling zone to a martensitizing temperature below the austenitizing temperature without contacting the heated plate with oxygen. Finally, immediately and without cooling of the cooled workpiece to a martensite start temperature, the cooled workpiece is deformed at least partially in a finishing press into a desired shape.

20 Claims, 1 Drawing Sheet

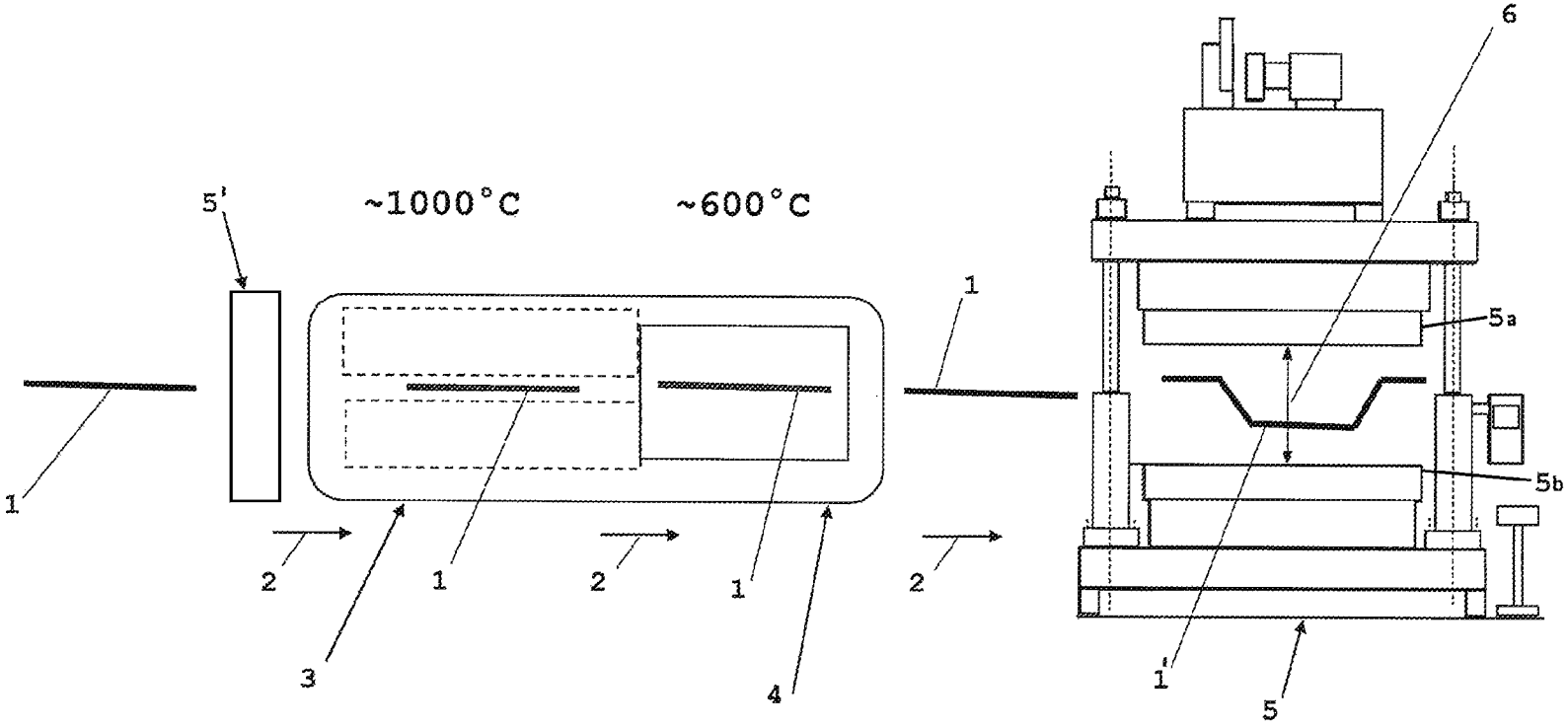
6
5a
5b
5
1'
1
2
~600°C
~1000°C
4
1
2
1
3
2
5'
1

METHOD OF PRESS-HARDENING A HOT-SHAPABLE PLATE

FIELD OF THE INVENTION

The present invention relates to a method of press-hardening a hot-shapable plate.

BACKGROUND OF THE INVENTION

In the prior art, it is known to separate workpieces, for example from a steel strip, and then to convey these workpieces successively into a furnace in which they are heated to austenitizing temperature or somewhat higher. After the workpieces have been appropriately heated, they are introduced into a forming and press hardening tool. The formed component is then removed from the tool and for example stored.

It is also known to first cold-form the workpieces after production from the steel strip and to trim the workpieces in a tool. This is then again followed by heating to the austenitizing temperature and transfer to a shaping and hardening tool in which the shaped component is hardened.

Uncoated workpieces can be press hardened, in which case scale has to be removed afterward, in a very costly manner, for example by sand blasting.

So far, only coated plates have usually been used which have, for example, an anticorrosion coating, in particular an Al—Si coating, a zinc coating or a coating made of a nonmetallic protective lacquer (X-tec®). Such coatings serve to avoid the formation of scale during heating and before shaping.

The disadvantage of such a corrosion protection coating is that it causes additional costs, and the shaping tool may also be contaminated by such coatings, so that it is subject to greater wear.

Another disadvantage is that a corrosion protection coating may cause hydrogen embrittlement of the workpieces.

OBJECTS OF THE INVENTION

It is therefore an object of the present invention to provide an improved press-hardening method.

Another object is the provision of such an improved press-hardening method that overcomes the above-given disadvantages, in particular that can be carried out inexpensively to produce press-hardened shaped parts.

SUMMARY OF THE INVENTION

A hot-shapable uncoated steel-plate workpiece is press hardened by first transporting the plate through a heating zone continuously or discontinuously and there heating the plate to an austenitizing temperature while blocking entry of oxygen into the heating zone. Then the heated plate is cooled in a cooling zone to a martensitizing temperature below the austenitizing temperature without contacting the heated plate with oxygen. Finally, immediately and without cooling of the cooled workpiece to a martensite start temperature, and the cooled workpiece is deformed at least partially in a finishing press into a desired shape.

A significant cost advantage is achieved through the use of bare, uncoated workpieces, because there is no need for a coating. Another advantage is that heating to the austenitizing temperature can be achieved more quickly than with coated workpieces. In this way, a considerable saving in energy is achieved. The material can also be procured more cheaply without an additional anticorrosion coating. In addition, hydrogen embrittlement caused by a coating does not occur.

In order to ensure that no scale formation takes place, the heating to the austenitizing temperature takes place without the admission of oxygen. Furthermore, the workpiece, which has been heated to the austenitizing temperature, is cooled to a temperature below the austenitizing temperature, but above the martensite start temperature, while further avoiding the ingress of oxygen. The workpiece is then immediately introduced into the hot-shaping tool within a very short time, which is to say within a few seconds, for example from one to five seconds, after leaving the cooling zone, and is there shaped and press-hardened.

The fact that entry of oxygen is avoided as far as possible also avoids scaling. At most, a thin oxide layer is formed, which is harmless for further processing.

The procedure according to the invention therefore shortens the warm-up time to the austenitizing temperature. The uncoated material is also more economical to procure than coated material, and the problem of hydrogen embrittlement does not arise.

As a second solution to the object specified at the beginning, the invention proposes a method for press hardening of workpieces made of a bare, uncoated plate that is first shaped into a molded part, then the at least partially or completely shaped workpiece is transported through a heating zone where it is continuously or discontinuously at least partially heated to at least the austenitizing temperature. During this heating to austenitizing temperature, oxygen access to the workpiece is prevented. The workpiece heated in this way is subsequently cooled to a temperature below the austenitizing temperature but above the martensite start temperature, while avoiding the admission of oxygen as an intermediate cooling step. The workpiece is then introduced into a hot shaping tool within a few seconds and before further cooling to martensite starting temperature, and final shaping is done in the tool if it has not yet been completely shaped. This press hardens the workpiece at least in some regions. Finally, the shaped workpiece is removed from the tool and stored elsewhere.

This proposal differs from the first-described method only insofar the uncoated workpiece is partially or completely preshaped so that a corresponding molded part is shaped from the plate material. This molded part is then treated according to the further procedural features. The advantages that are given with regard to the first solution also apply to the second solution.

Preferably the workpiece is heated in a continuous furnace. It can also be transported through a roller hearth furnace and heated therein. Because the workpieces are uncoated, there is less wear on the rollers in the roller hearth furnace, since the rollers are not damaged by the coating material, so that maintenance costs are lower.

The continuous furnace can be heated with gas or electrically. Heating with gas is preferred, but heating by electricity is also possible. Corresponding power-operated heating units are known in the prior art.

As an alternative or in addition, the plate is heated inductively or conductively, if necessary upstream of the continuous furnace. Also, the workpiece can be straightened and/or rolled before entering the heating zone.

Either way, heating is done in an atmosphere of protective gas, in particular inert gas. This procedure is easy to control and leads with a high degree of certainty to the avoidance of scale formation.

The intermediate cooling can be carried out by a lead bath, salt bath or a bath in a comparable medium in which the plate temperature is set to a range below 750° C. and above the martensite start temperature of 420° C. This allows the temperature to be set in the desired range in a simple manner, so that it is at least below 750° C. in order to avoid the formation of scale, on the other hand it is set considerably above the martensite start temperature so that deformation and press hardening are possible.

Alternatively, it can also advantageously be provided that the intermediate cooling is carried out by a cool inert gas, to a temperature between 750° C. and 420° C. This intermediate cooling can also be done by a cooled tool or between cooled plates of a press.

Preferably the workpiece from the continuous furnace is fed directly to the intermediate cooling via a closed system connected to it, so that the workpiece is transported from the continuous furnace into the intermediate cooling zone without the admission of oxygen, preferably under an inert gas atmosphere. Here, the continuous furnace can be designed as a roller hearth furnace, for example. In order to avoid oxygen access to the plate when it leaves the continuous furnace and is introduced into the intermediate cooling, transport from the continuous furnace into the intermediate cooling takes place without oxygen, for example by having a connecting tunnel between these two units so that the entry of atmospheric oxygen is prevented and the protective gas atmosphere can be maintained.

In addition, preferably the continuous furnace and/or the intermediate heating and cooling zones are protected against the ingress of air on the inlet side and on the outlet side by respective air locks. Such locks largely avoid the entry of air when workpieces are introduced into the closed zones or are transported out of them.

Depending on the intended use, preferably parts of the plate are cooled for different lengths of time or are exposed to the cooling protective gas atmosphere in order to produce regions with different technical or mechanical properties. For this purpose the transport speed of the workpiece is controlled.

Also the workpiece can be transported into the shaping tool by a roller conveyor and/or by a handling robot.

It is particularly preferable that regions with the following structural configurations of the plate are generated:

100% martensitic structure, predominantly martensitic structure with components of austenite, ferrite, bainite and/or pearlite, 1% to 99% martensite or 1% to 99% bainite, 1% to 99% martensite and the remainder austenite, or Mainly bainite, the rest austenite, ferrite, martensite and/or pearlite.

In particular, preferably the steel workpiece plate is of quality 22MnB5 or equivalent.

If the workpiece is already partially or completely reshaped in a press prior to press hardening, a residual reshaping of the only partially reshaped workpiece of the order of 0.1% to 10% takes place during press hardening.

This residual deformation can vary depending on the component.

In addition, the plate is a rectangular piece of sheet.

It can also be provided that the plate consists of a precut sheet part.

In this case, in the first step, a sheet part is cut out of a rectangular workpiece, which then forms the further workpiece that is treated according to the method.

It is also preferably provided that shape of the sheet metal part is optimized by edge trimming after one of the pressing processes.

Holes, recesses, contours or other processing operations are also made in the workpiece, specifically before or after one of the pressing processes. Corresponding components frequently have holes as recesses and contours or also machinined faces or edges that can likewise be formed on the workpiece either before or after the pressing processes.

One possible procedure is that the workpiece is reshaped at room temperature.

A variant that is advantageous under certain circumstances is that the workpiece is reshaped at a temperature that is higher than room temperature in order to improve the reshaping properties, the temperature increase taking place by heating the workpiece and/or the shaping tool.

The deformation at higher temperatures compared to room temperature leads under certain circumstances to better deformation properties. For the purpose of increasing the temperature, both the plate and its tool(s) can be heated.

An alternative, possibly advantageous procedure is that the workpiece is reshaped at a temperature lower than room temperature, the temperature of the workpiece and/or the reshaping tool being lowered.

In this case, if appropriate, the temperature is reduced by cooling with nitrogen, possibly liquid nitrogen.

When the temperature is lowered, which can be achieved, for example, by a component or tool cooled with nitrogen, effects that resemble a lubricant are achieved under certain circumstances, with the very cold nitrogen disappearing automatically after the shaping process and no disadvantageous effects resulting.

It should also be noted that the material from which the circuit plate is preferably made cannot only be a 22MnB5 or a comparable material. The analysis of an existing material can also be optimized in order to adapt it to the process sequence. For example, the carbon content, the manganese content or the boron content can be adjusted accordingly, as can other alloying elements.

Another special feature of the process is that the workpieces made of custom workpieces material with varying material thicknesses are used.

So-called custom workpiece material is known in the prior art. In this case, workpieces from a starting material are rolled to a different thickness and then workpieces with different material thicknesses are connected to one another, in particular welded and processed further. Such materials can also be used for the method according to the invention.

Another possibility consists in using the workpiece made of flexibly rolled material with a changing material thickness.

Such flexibly rolled material is also known in the prior art. Here, strip material is rolled out to different thicknesses and then cut into workpieces so that the workpieces do not have a uniform sheet thickness, but have different sheet thicknesses.

This material can also be used advantageously for the purposes according to the invention.

A special feature is that the plate is used completely or partially made of a thin material of 1.5 mm or less.

Materials that are at most 1.5 mm thick are used in the method according to the invention are particularly adapted to the inventive method. As a result of the intermediate cooling provided, the material is stiffer after the intermediate cooling than in the case of press hardening without intermediate cooling, which leads to an advantageous procedure.

Another special feature is that the workpiece is heated in the heating zone for a time of less than 5 minutes in order to avoid or minimize grain enlargement.

Since, according to the invention, no holding time of 5 minutes or more is necessary, as is necessary in the prior art for a coating with AlSi, for example, the structure of the material of the plate can be optimized according to the invention by temperature and time. In this way, grain enlargement can be prevented, and it is possible to react better to customer requests if a customer-specific structure/grain size is to be set.

BRIEF DESCRIPTION OF THE DRAWING

The above and other objects, features, and advantages will become more readily apparent from the following description, reference being made to the accompanying drawing whose sole FIGURE is a schematic diagram illustrating the method of this invention.

SPECIFIC DESCRIPTION OF THE INVENTION

As seen in the drawing, a workpiece 1 is transported in a travel direction 2 through a heating zone 3 where the workpiece is heated continuously or discontinuously at least partially, preferably completely, at least to austenitizing temperature or slightly above it, here to about 1000° C.

The workpiece 1 is an uncoated plate of hot-shapable steel. Here, during heating in the heating zone 4 to the austenitizing temperature, oxygen is blocked from entering to prevent oxidizing of the workpiece. The workpiece 1 heated to the austenitizing temperature is cooled in an intermediate cooling zone 4 to a temperature below the austenitizing temperature but above the martensite start temperature, for example to 600° C., while further avoiding the entry of oxygen. The workpiece 1 is then put into the shaping tool 5 within a few seconds of leaving the cooling zone 4. The workpiece temperature is there about 550° C. In the shaping tool 5, the workpiece 1 is shaped and press-hardened at least partially. The reshaped workpiece 1 can then be removed from the reshaping tool 5 and stored elsewhere.

In the drawing, the shaping tool 5 is only illustrated schematically. It consists of an upper part 5*a* and a lower part 5*b* generally complementary to the upper part 5*a*. These two parts 5*a* and 5*b* can be brought together and separated as shown by arrow 6. When the tool 5 is open, the workpiece 1 can be inserted and, by closing the tool, the workpiece 1 can be reshaped and press-hardened. After the shaping tool 5 has been opened, the workpiece 1 can be removed in the final shaped form.

The heating zone 3 is shaped for example by a continuous furnace or a roller hearth furnace into which the workpiece is introduced through an air lock that protects against the ingress of air, and is carried away through a further air lock at the end. When entering the intermediate cooling zone 4, a lock can again be provided at the upstream end and a lock at its downstream end to prevent the entry of air. The continuous furnace shaping the heating zone 3 is preferably heated with gas, and heating in the continuous furnace taking place under a protective gas atmosphere containing no oxygen in order to avoid scaling of the workpiece. The workpiece 1, already heated to the austenitizing temperature, enters the intermediate cooling zone 4 under a protective housing, again avoiding the entry of oxygen or air.

The intermediate cooling 4 can for example be a lead bath. Here, the temperature of the workpiece can be cooled down to about 600° C., whereby it in any case remains well above the martensite start temperature, so that shaping and press hardening can be carried out in the corresponding shaping tool 5. The workpiece 1 leaves the intermediate cooling 4 at 600° C., for example, and is introduced into the shaping tool within a few seconds, the workpiece 1 then still having a residual temperature that is somewhat lower, for example 550° C.

As shown schematically at 5', it is possible to preshape the workpiece at a temperature equal to above or below room temperature. This stage 5' may also be used for form holes or recesses in the workpiece or adjust its edge shape.

The invention is a method that produces a high-quality shaped product from a starting material that is inexpensive to procure and provide and the energy consumption is kept relatively low from the beginning of the heating up to the shaping.

The invention is not restricted to the illustrated embodiment, but is variable in many ways within the scope of the disclosure.

All individual and combination features disclosed in the description or drawing are part of the invention.

I claim:

1. A method for press hardening of a hot-shapable uncoated steel plate, the method comprising the steps of:

transporting the plate through a heating zone continuously or discontinuously;

heating the plate in the heating zone to an austenitizing temperature while blocking entry of oxygen into the heating zone;

cooling the heated plate in a cooling zone to a martensitizing temperature below the austenitizing temperature without contacting the heated plate with oxygen; and immediately and without cooling of the cooled workpiece deforming the cooled workpiece at least partially in a finishing press into a desired shape.

2. The press-hardening method according to claim 1, further comprising the step, before transporting the plate through the heating zone, of:

partially preshaping the plate into a predetermined intermediate shape.

3. The press-hardening method according to claim 1, wherein the steps of heating and cooling are carried out in an inert-gas atmosphere.

4. The press-hardening method according to claim 1, wherein the cooling step is carried out by immersion of the plate in a lead or salt bath to cool the plate to between 420° C. and 750° C.

5. The press-hardening method according to claim 1, wherein the cooling step is carried out y conduction under an inert-gas atmosphere to a temperature between 750° C. and 420° C.

6. The press-hardening method according to claim 1, wherein the cooling step is carried out by engaging the plate with a refrigerated tool or between cooled tool plates.

7. The press-hardening method according to claim 1, further comprising the step of:

displacing the plate from the heating zone to the cooling zone without exposing the plate to oxygen.

8. The press-hardening method according to claim 1, wherein the heating zone or the cooling zone has an upstream intake end provided with an airlock and a downstream end provided with an air lock.

9. The press-hardening method according to claim 1, wherein different portions of the plate are heated or cooled differently to produce zones in the plate with different properties.

10. The press-hardening method according to claim 9, wherein the portions include portions with:

100% martensitic structure, predominantly martensitic structure with components of austenite, ferrite, bainite and/or pearlite, 1% to 99% martensite or 1% to 99% bainite, 1% to 99% martensite and the remainder austenite, or mainly bainite, the rest austenite, ferrite, martensite and/or perlite.

11. The press-hardening method according to claim 1, wherein the method produces a residual deformation of 0.1% to 10% during the deforming step.

12. The press-hardening method according to claim 1, further comprising the step of forming the plate with a hole, a recess, or an edge contour.

13. The press-hardening method according to claim 2, further comprising the step of:

shaping the plate at room temperature.

14. The press-hardening method according to claim 2, wherein the plate is shaped by heating the plate above room temperature by contact with a heated shaping tool.

15. The press-hardening method according to claim 2, further comprising the step of:

cooling the plate to below room temperature by contact with a cooled shaping tool.

16. The press-hardening method according to claim 1, wherein the plate is cooled by contact with liquid nitrogen.

17. The press-hardening method according to claim 1, wherein the plate is of varying thickness.

18. The press-hardening method according to claim 1, further comprising the step of:

cutting the plate from a rolled strip of varying thickness.

19. The press-hardening method according to claim 1, wherein the plate has a thickness of at most 1.5 mm.

20. The press-hardening method according to claim 1, wherein the plate is heated in the heating zone for less than 5 minutes to avoid or minimize grain coarsening.

* * * * *